United States Patent [19]

Spengler

[11] Patent Number: 4,539,908

[45] Date of Patent: Sep. 10, 1985

[54] PRINTING UNIT WITH AN ELECTROSTATIC PRINTING AID COMPRISING ELECTRODES CONTAINED IN A LID STRUCTURE

[75] Inventor: Walter Spengler, Biel-Benken, Switzerland

[73] Assignee: Electronova S.A., Panama

[21] Appl. No.: 555,950

[22] Filed: Nov. 29, 1983

[30] Foreign Application Priority Data

Dec. 27, 1982 [CH] Switzerland ..... 7566/82

[51] Int. Cl.[3] ..... B41M 1/10; B41F 5/04; B41F 9/00; B41F 11/00

[52] U.S. Cl. ..... 101/426; 101/153; 101/216; 101/DIG. 13; 118/621; 118/651; 250/325; 346/153.1; 355/3 P; 430/902

[58] Field of Search ..... 101/DIG. 13, DIG. 15, 101/152, 153, 170, 216, 217, 219, 426; 346/153.1, 154, 155, 156; 355/3 P, 10; 250/324, 325, 326; 118/621, 622, 623, 624, 625, 626, 644, 651, 659, 660, 661, 662; 430/902

[56] References Cited

U.S. PATENT DOCUMENTS

| | | | |
|---|---|---|---|
| 2,930,847 | 3/1960 | Metzger | 346/154 |
| 3,184,749 | 5/1965 | Groth | 101/DIG. 13 |
| 3,348,232 | 10/1967 | King | 346/156 |
| 3,417,404 | 12/1968 | Macorski | 101/DIG. 13 |
| 3,438,052 | 4/1969 | Young | 346/156 |
| 3,715,640 | 2/1973 | Sato | 430/902 |
| 3,765,026 | 10/1973 | Rittler | 346/155 |
| 3,788,844 | 1/1974 | Sato | 430/902 |
| 3,789,224 | 1/1974 | Sato | 430/902 |
| 3,957,510 | 5/1976 | Hermanson | 355/3 P |
| 3,979,757 | 9/1976 | Kilby | 346/155 |
| 4,005,436 | 1/1977 | Kleinknecht | 346/155 |
| 4,049,343 | 9/1977 | Hermanson | 355/3 P |
| 4,208,965 | 6/1980 | Eichler | 101/153 |
| 4,364,313 | 12/1982 | Hyllberg | 101/153 |

FOREIGN PATENT DOCUMENTS

| | | | |
|---|---|---|---|
| 2843182 | 5/1979 | Fed. Rep. of Germany | 101/DIG. 13 |
| 480179 | 12/1969 | Switzerland | 101/DIG. 13 |
| 383630 | 12/1970 | U.S.S.R. | 101/DIG. 13 |

OTHER PUBLICATIONS

Clauer, High-Speed Printer Mechanism, Jun. 1958, IBM Tech. Disclosure Bulletin, vol. I, No. 1, p. 7.

Hartmann, Electro-Erosion Printer with Arrangement for Feeding Electrodes, Dec. 1978, IBM Tech. Dis. Bull., vol. 21, No. 7, p. 2873.

*Primary Examiner*—Clyde I. Coughenour
*Assistant Examiner*—William L. Klima
*Attorney, Agent, or Firm*—Ladas & Parry

[57] ABSTRACT

The printing unit (1) operating with an electrostatic printing aid has an inductor device (7) for transmitting an electrostatic charge to an outer-shell layer (5) of a back-up cylinder (4). The inductor device is provided on one end face (14) of the back-up cylinder and engages over this end face in the manner of a lid. A continuous annular air gap (15) is located between the end face and the inductor device. Inductor electrodes (9) serve for transmitting the electrostatic charge to the outer-shell layer in a contactless manner and are arranged, concealed against outside access, on the inner face of the inductor device and are aligned by means of their electrode tips with an end-face edge (10) of the outer-shell layer (5). So that no impurities can penetrate into the air gap, it is sealed off or constantly scavenged by compressed air.

12 Claims, 4 Drawing Figures

Figure 1:
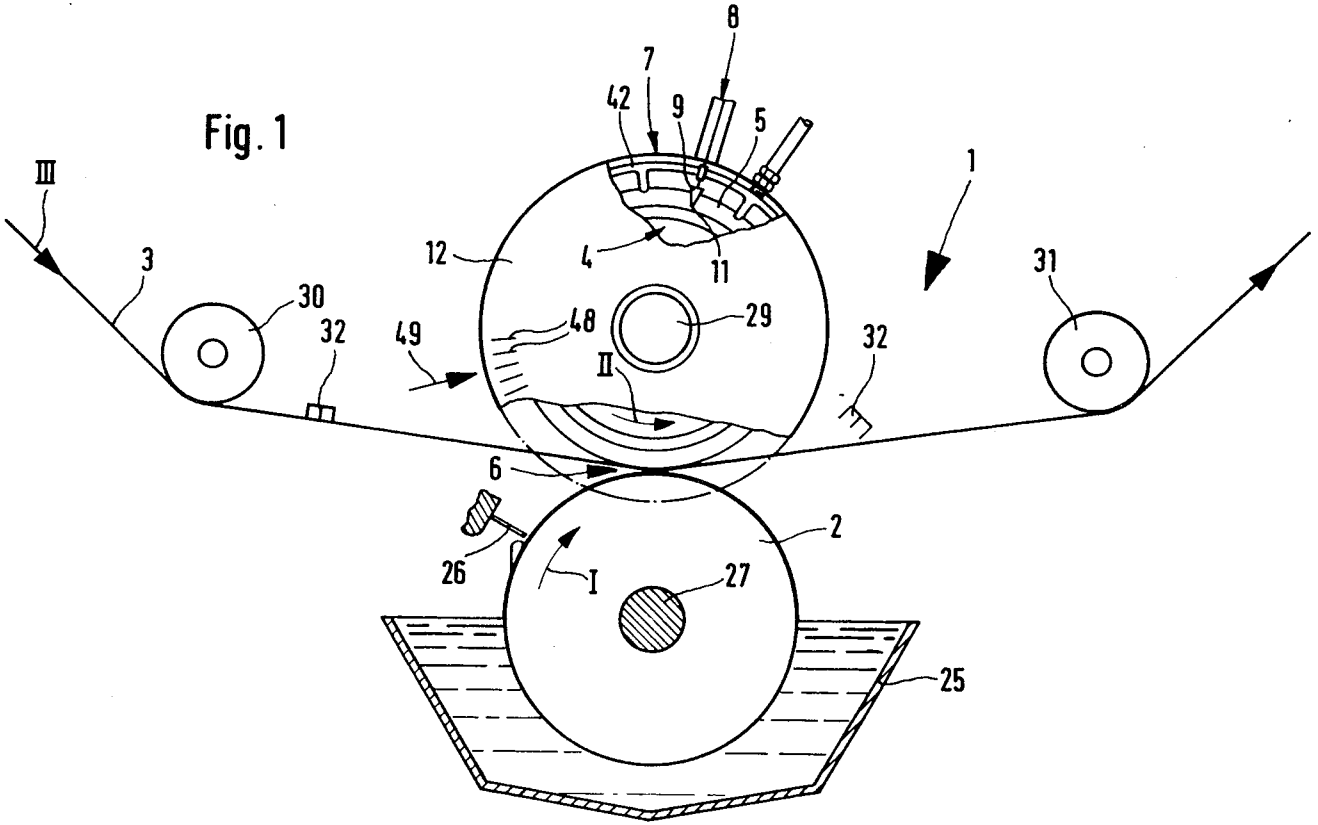

PRINTING UNIT WITH AN ELECTROSTATIC PRINTING AID COMPRISING ELECTRODES CONTAINED IN A LID STRUCTURE

The invention relates to a printing unit, especially a gravure machine, with an electrostatic printing aid for assisting the transfer of ink from an impression cylinder onto a dielectric substrate web, in a nip formed between the surface of the impression cylinder and an electrostatically chargeable outer-shell layer of a back-up cylinder, with an inductor device fed with high voltage for the electrostatic charging of at least one portion, running at any particular time into the nip, of the outer-shell layer of the back-up cylinder.

In a known printing unit of the type mentioned above, there is an inductor device with an elqngated electrode carrier into which one or more rows of electrodes are worked. High voltage is fed to these electrodes, and they have tips which project from the electrode carrier and which transfer the charge to the outer-shell layer. For this purpose, the electrode carrier is aligned at a suitable point in the printing unit so that the tips are approximately parallel to the outer-shell layer along the back-up cylinder, and the electrical charge is thereby induced in a contactless manner.

Such an inductor device, seen in isolation, works in a very satisfactory way, but specific influences caused by the printing process result in difficulties, above all after the inductor device has been in use for a relatively long period of time. In the region surrounding a printing unit, there forms, during the time when it is in operation, an atmosphere which is enriched with ink and solvent particles and with material dust from the substrate web to be printed. Over a period of time, such particles and paper dust also settle on the inductor device and, above all, on the electrode carrier and become clogged there. If the inductor device is not included in the usual regular cleaning operations on the printing unit, there forms, especially in places on the inductor device which are difficult to reach, an ink and dirt covering which, although the ground insulation of the electrodes is otherwise sufficient, conducts tracking currents and favors voltage flash-overs, specifically especially from the electrode tips to the ground connection which has to be provided for the inductor device. In addition to the power loss which occurs and a weakening of the induction of an electrostatic charge onto the outer-shell layer, a spark flash-over, once it has started and not yet stopped, results in rapid destruction of the inductor device and also increases the general danger of fire.

To prevent completely the possibility of such a disadvantageous formation of contact bridges and tracking-current paths on the inductor device, it was proposed to accommodate an inductor device in the interior of the conventionally hollow-cylindrical back-up cylinder, where the inductor device would be completely shielded against impurities. However, it is possible to arrange an inductor device inside a back-up cylinder only in those cylinders in which the interior does not have to be used for another purpose. In especially long and slim back-up cylinders, the interior is filled, for example, with elements of a hydraulically operating supporting device which is intended to ensure rotational stability. If there is any possibility at all of also accommodating an inductor device in back-up cylinders of this type, it can only be achieved by means of a disproportionately high technical outlay.

The object of the invention is to provide a printing unit of the type defined in the introduction, in which, whilst maintaining the most efficient charge application possible and uniform charge distribution of the outer-shell layer of a back-up cylinder, the inductor device is designed and arranged in such a way that the induction process is prevented from being impaired in any way by ink and solvent constituents and impurities of any kind.

This object is achieved, according to the invention, in the way defined in patent claim 1. According to this, the inductor device is located on at least one end face of the back-up cylinder and simply because of this method of arrangement provided according to the invention is advantageously taken out of the region in which there is the greatest possibility of contamination. Furthermore, the inductor device according to the invention is provided with at least one inductor electrode which is located next to an end-face edge of the outer-shell layer so as to be concealed against outside access. As a result of this covered method, as seen from the outer region of the back-up cylinder, of supplying an electrostatic charge to the outer-shell layer or to its end-face edge, an advantageous shielding of the inductor electrode and the charge-carrying elements is achieved.

According to an advantageous embodiment of the invention, the inductor device has an electrode carrier which is attached in the manner of a lid on the end faces of a back-up cylinder. Between this lid-shaped electrode carrier and the end face of the back-up cylinder there is such a distance that an annular air gap is obtained between these two parts. Several inductor electrodes are provided in this annular air gap, distributed circularly on the outer-shell layer of the back-up cylinder, and transfer their charge to the outer-shell layer via their electrode tips in a contactless manner.

Figure 2:
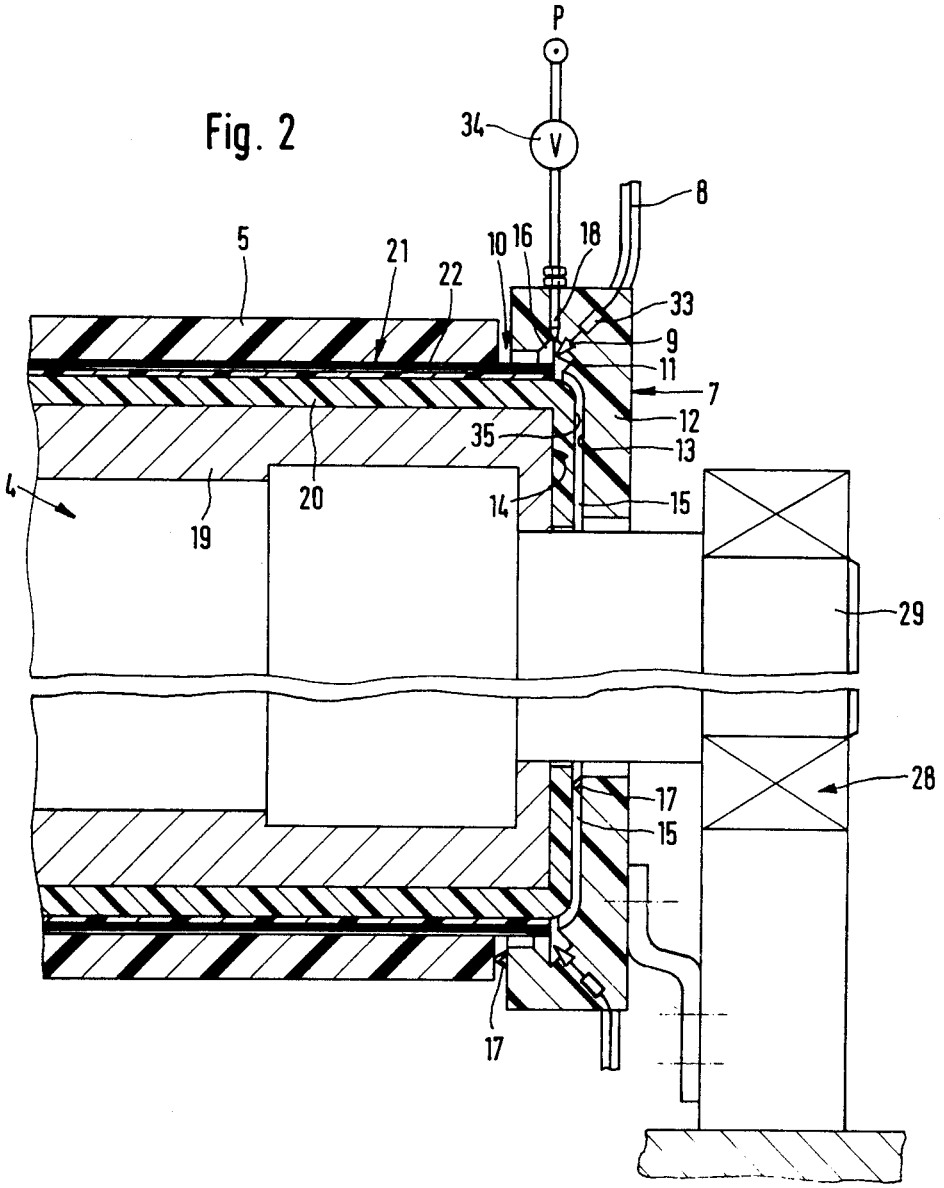
Figure 3:
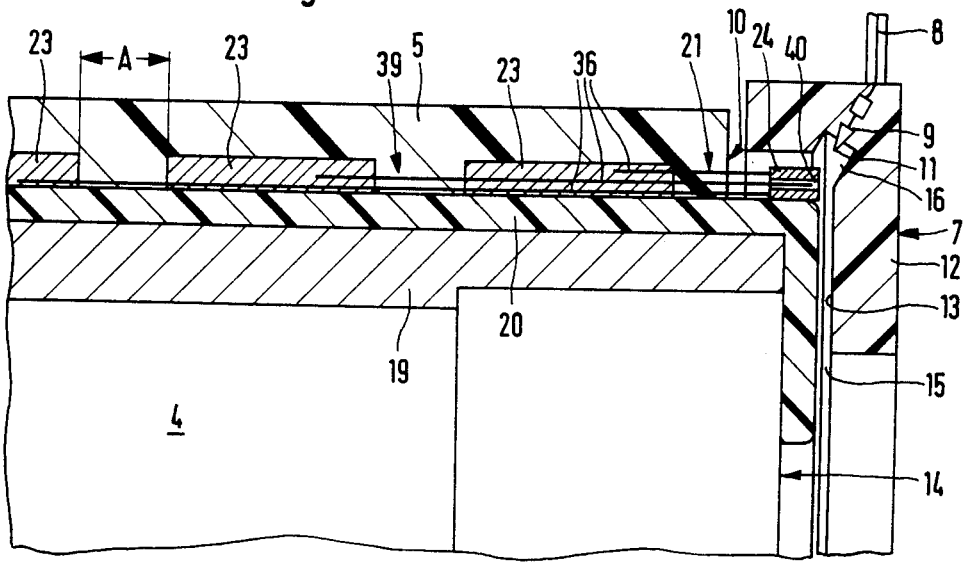
Figure 4:
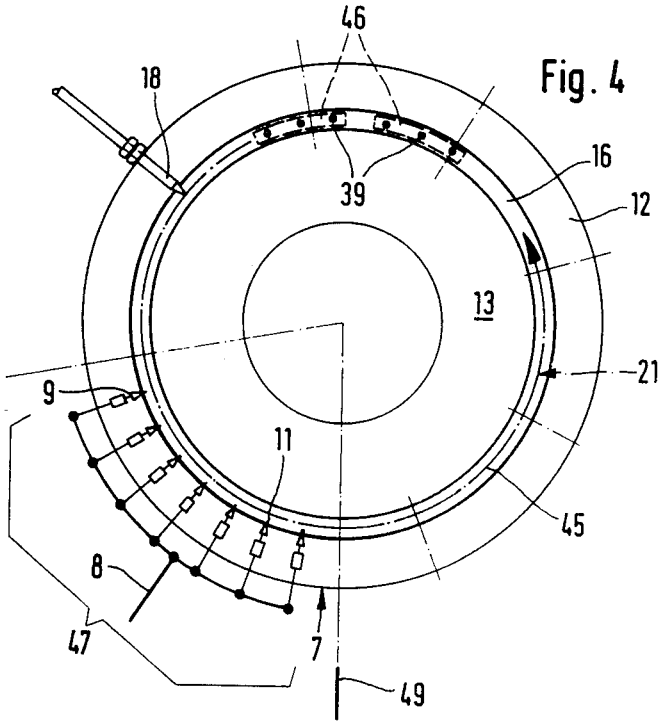

The dependent claims characterize further preferred exemplary embodiments of the invention. Some exemplary embodiments of the invention are explained in more detail below with reference to drawings in which:

FIG. 1 shows a diagrammatic side-view of a printing unit according to the features of the invention, FIG. 2 shows a partial longitudinal section through an end portion of a back-up cylinder with an inductor device, FIG. 3 shows a partial longitudinal section similar to that of FIG. 2 to illustrate a modified embodiment of the back-up cylinder with the inductor device according to FIG. 2, and FIG. 4 shows an inside view of an alternative form of the inductor device according to FIG. 2.

According to FIG. 1, a printing unit 1 incorporates an impression cylinder 2 dipping into an ink bath located in an ink duct 25. When the impression cylinder 2 rotates in the ink bath, it picks up on its surface printing ink which is scraped off by a ductor blade 26, so that ink remains only in the engraving wells of the surface of the impression cylinder. The impression cylinder 2 is rotated on a central shaft 27 by means of a drive (not shown) and moves in the direction of the arrow I.

In FIG. 1, located above the impression cylinder 2 is a back-up cylinder 4 which is supported rotatably by means of a concentric shaft 29 in a bearing arrangement 28 on the frame (not shown) of the printing unit. This back-up cylinder 4 is driven in the opposite direction to the impression cylinder 2 in the direction of the arrow II. Formed between the back-up cylinder 4 and the impression cylinder 2 is a nip 6 through which a substrate web 3 to be printed is guided. This substrate web 3 can be drawn off in the direction of the arrow III from a supply roll (not shown), introduced into the printing unit 1 along a first guide roller 30 and, after passing through the nip 6, fed along a second guide roller 31 to a further following printing unit or a rolling-up device. An ionizer 32 is arranged just above the substrate web 3 between the guide roller 30 and the nip 6 and between the latter and the guide roller 31; the two ionizers serve for diverting electrostatic charges from the substrate web.

The back-up cylinder 4 shown in the Figures has a hollow cylinder 19 made of metal which forms the supporting roller body and into which the bearing shafts 29 located on the end faces are firmly fitted. A casing 20 consisting of electrically insulating material with a high dielectric constant is attached to the outer surface of this hollow cylinder 19. According to FIG. 2, the electrostatically chargeable outer-shell layer 5 which consists of a semiconductor material is located on this casing. It is preferable to select for the outer-shell layer a polyurethane which is resistant to abrasion and which has an elasticity which takes into account the mechanical printing requirements.

An inductor device 7 in the form of an annular disk having a central orifice for the bearing shaft 29 is visible in FIG. 1, as seen in the axial direction of the back-up cylinder 4. In the cross-sectional representation of FIGS. 2 and 3 it is evident that the inductor device 7 is formed in the manner of a lid and is attached close to an end face 14 of the back-up cylinder 4 and an end-face edge 10 of the outer-shell layer 5. The inductor device 7 incorporates an electrode carrier 12 with an inner face 13 formed to correspond to the end-face edge 10 and an annular end-face surface 35 of the back-up cylinder 4, so that an annular air gap 15 is formed between the inner face of the electrode carrier 12 and the said portions of the back-up cylinder 4. If the inductor device 7 is attached fixedly, in the way indicated in FIG. 2, to the bearing arrangement 28 or even in another place on the printing unit frame, when the back-up cylinder 4 rotates it always remains stationary at the distance formed by the annular air gap 15 from the opposite portions of the back-up cylinder.

A continuous annular groove 16 is made in the annular air gap 15 at the height of the outer-shell layer 5. Electrode tips 11 of inductor electrodes 9 which are embedded in the electrode carrier 12, distributed approximately uniformly over its periphery, end in this annular groove. Each inductor electrode 9 is connected to a high-voltage supply 8 via an appropriate electrical coupling element 33. This high-voltage supply 8 can be guided to each inductor electrode in the form of a separate line or can be designed as a ring main from which branches lead to each inductor electrode. The electrode carrier 12 can consist of cast resin into which the electrodes 9, the coupling elements 33 and the high-voltage supplies 8 can be cast. The electrode tips 11 project into the annular groove 16 to such an extent that a sufficiently large tip portion is available on each tip for transmitting the charge to the outer-shell layer. The number of electrode tips provided in an annular groove 16 or the number of inductor electrodes 9 provided in the electrode carrier 12 depends on several factors, for example the diameter of the back-up cylinder 4, the amount of charge to be applied, the type of design of the conductor means 21 on or in the outer-shell layer 5, the resistance value of this layer which can vary over the length of the back-up cylinder towards the roller center, etc. If the number of electrodes to be accommodated in an electrode carrier 12 is not sufficient in specific cases of use, an inductor device 7 could be provided on each of the two end faces of a back-up cylinder. This method of supplying an electrostatic charge to the outer-shell layer 5 on both sides can also assist a more uniform charge distribution in the axial direction of the back-up cylinder.

As already mentioned, the advantageous arrangement and design of the inductor device 7 at the end face 14 of the back-up cylinder 4, in conjunction with the arrangement of the inductor electrodes 9 so that they are concealed against outside access, already ensures by itself a transmission region substantially protected from contamination for the charge to be applied to the outer-shell layer. To close this transmission region off completely, gaskets 17 bridging the air gap 15 are provided, as shown in the lower half of FIG. 2, between the electrode carrier 12 and the outer-shell layer 5 and the annular end-face surface 35 of the back-up cylinder 4. These gaskets can be designed as shaft-sealing or surface-sealing rings of conventional type. They can be fastened to the electrode carrier 12, touch the outer-shell layer or the annular end-face surface 35 with their sealing lips and thereby close the annular air gap 15 off completely.

In the embodiment illustrated in the upper half of FIG. 2, there are no gaskets, but the annular air gap 15 is constantly scavenged with compressed air during operation. To enable this compressed air to be supplied, several compressed-air nozzles 18 are provided in the annular groove 16 of the electrode carrier 12, distributed over the periphery of the annular groove, and are connected to a-compressed-air source P via an appropriate valve 34. When compressed air is supplied to the annular groove 16, it can both escape between the electrode carrier 12 and the end-face edge 10 of the outer-shell layer 5 and flow off in the vicinity of the bearing shaft 29 of the back-up cylinder 4. Because of this scavenging with compressed air, the annular gap 15 and its opening regions are protected against the penetration of impurities. This is advantageously ensured in a completely contactless manner. In the illustration in FIG. 1, the delivery line for compressed air to the individual nozzles 18 is designed as a ring main 42 which is cast into the electrode carrier 12 and which can be connected to the compressed-air source P shown in FIG. 2.

To ensure a distribution of the electrostatic charge which is uniform over the entire outer-shell layer 5, it is necessary, on the one hand, to transfer this charge from the inductor device 7 in an axial direction; on the other hand, the charge must be prevented from flowing off to the bearing shaft 29 and consequently to ground. To prevent the charge from flowing off laterally from the inductor electrodes 9 in this way, the electrically insulating casing 20 is, as shown in FIGS. 2 and 3, extended on the end face 14 of the back-up cylinder 4 towards the bearing shaft 29 and fastened to the end face on the outside. So that the charge can be transferred to the outer-shell layer 5 and distributed there in as uniform a way as possible, there are conduction means 21 which, in the embodiment according to FIG. 2, are worked into the outer-shell layer 5 and are exposed towards the electrode tips 11. Depending on whether the entire surface of the outer-shell layer or only portions of this layer are to be provided with an electrostatic charge, these conduction means 21 can be designed in the form of a conductor foil 22 extending continuously over the entire layer surface or they can be conduction strips 23 (FIG. 3) which form electrically conductive peripheral segments within the outer-shell layer 5. Also, the conduction means 21 can be conductor tracks which extend axially in the outer-shell layer and a plurality of which can be arranged next to one another and distributed in a peripheral direction, so that these conductor tracks pass through the outer-shell layer 5 in the form of a grid. The peripheral distance between the conductor tracks is appropriately selected so that the electrostatic charge can be distributed uniformly on the outer-shell layer between adjacent conductor tracks.

One and the same back-up cylinder 4 will very often be used for printing substrate webs 3 of different widths. If the entire outer-shell layer 5 were to be charged electrostatically, for example, in the case of a narrow substrate web 3 which covers only approximately a third of the length of the back-up cylinder, the regions located outside the substrate web could pick up ink from the impression cylinder 2 in an undesirable way because of their electrostatic charge. It is therefore advantageous, to ensure the possibility of universal use of a back-up cylinder, if its electrostatically chargeable outer-shell layer 5 can, at a particular time, be charged electrostatically approximately according to the width of the substrate web 3 to be printed. In the exemplary embodiment according to FIG. 3, the charge can be induced on individual conduction strips 23, whilst others can remain essentially free of charge. This is effected by transferring the charge from the inductor device 7 to an inductor ring 24 which is attached to the end-face edge of the electrically insulating casing 20. The conduction strips 23 which are at a distance A from one another are controlled individually from this inductor ring via contact bridges 39. As shown diagrammatically in FIG. 3, all three conductor strips 23 can be connected to the inductor ring 24 via the contact bridges 39 or else two of the conductor strips present or only a single conductor strip can be induced. It is sufficient, for this purpose, to connect or disconnect or to insert or remove the contact bridges 39 according to the appropriate type of use of the back-up cylinder 4. In the embodiment illustrated, the contact bridges 35 are designed as thin steel wires 36 which are assigned to the particular conduction strip 23 to be controlled. These steel wires 36 are connected to the inductor ring 24 by pushing them into small axial bores 40 distributed over the periphery of the inductor ring.

Also, the contact bridges 39 could be conductors which are connected firmly to the conduction strips 23 and to the hollow-cylinder wall construction of the back-up cylinder and in which suitable high-voltage switching elements are incorporated so that the particular conductors can be connected up to the inductor ring 24.

The embodiment of the inductor device 7 as shown in FIG. 4 is used for back-up cylinders 4, the outer-shell layer 5 of which is not to be charged electrostatically over its entire peripheral surface, but only in a surface region which is limited in a peripheral direction and which is preferably located in front of the nip 6 in the running direction.

The inside view of the inductor device 7, shown diagrammatically in FIG. 4, illustrates the electrode carrier 12 with the peripheral groove 16 into which the compressed-air nozzle 18 opens. As indicated, several such compressed-air nozzles could be provided distributed over the ring periphery. In this embodiment also, the scavenging of the annular air gap 15 (FIG. 2) can be replaced by sealing-off measures in the way described with reference to FIG. 2.

In an angular segment 47 of the electrode carrier 12 there are several inductor electrodes 9, the electrodes tips 11 of which project into the part of the peripheral groove 16 delimited by the angular segment 47. No electrodes supplying high voltage are arranged in the region of the electrode carrier 12 located outside this angular segment 47. The angular segment delimits an angular range of approximately 90°–120° of the peripheral groove 16.

The conduction means 21 located on the back-up cylinder are indicated in FIG. 4 by a circular dot-and-dash line. The outer-shell layer 5 of the back-up cylinder 4 is provided, for the intended use described above, with conduction means 21 which distribute the electrostatic charge, applied on the end face, on the above-mentioned limited surface region in the axial direction of the roller and at the same time in the running direction. An exemplary embodiment of conduction means of this type is the conductor tracks described with reference to FIG. 3, which lie axially in the outer-shell layer and are distributed in a peripheral direction and via which the back-up cylinder can be charged, for example over a predetermined width. In another alternative form of such conduction means, the conduction strips 23 described with reference to FIG. 3 need not be guided continuously round the back-up cylinder in the direction of rotation, but can be designed as a successive series of conductive peripheral sectors 45, as shown diagrammatically in FIG. 4. Here, the peripheral sectors 45 are controlled, in a similar way to that shown in FIG. 3, via an inductor segment ring 46 (FIG. 4) on the end-face edge of the electrically insulating casing 20 of the back-up cylinder 4 and via the contact bridges 39 of different lengths. In the embodiment according to FIG. 3, the inductor ring 24 is made continuously conductive in a peripheral direction. In contrast to this, the inductor segment ring 46 according to FIG. 4 is designed like a commutator in which conductive and non-conductive segment surfaces alternate in a peripheral direction. The segment length depends on the length of the peripheral sectors 45 and the charge requirements in question. FIG. 4 shows diagrammatically, in each inductor segment surface of the ring 46, for example three of the small axial bores 40 illustrated in FIG. 3.

When the back-up cylinder rotates in the direction of the arrow shown on FIG. 4 and when the center of the nip 6 (see FIG. 1), indicated by the vertical line 49 lies on the lower side of the illustration in FIG. 4, the angular segment 47 is located in front of the nip in the running direction. The electrodes 9 which are located within the angular segment and the number of which depends on the operating and charge requirements of the printing unit, each transfer their charge onto the edge portion passing through the angular segment 47, with the result that the corresponding outer-shell region is charged electrostatically. During passage through the nip, this charge acts on the substrate web 3 and on the printing-ink transfer and is diverted via the grounded impression cylinder 2. After the electrostatically charged portion of the outer-shell layer 5 has passed through the nip 6, the outer-shell layer 5 is essentially free of charge and remains so until it reaches the angular segment 47 again. The particular advantage of keeping the surface of the back-up cylinder 4 free of electrostatic charge in the region of the back-up cylinder located outside the roller portion required for the printing process is that the outer-shell layer 5 is now virtually incapable of attracting layer-contaminating particles from the vicinity. Advantageously, it is also possible to do away with the ionizer 32 shown in FIG. 1 on the discharge side of the substrate web 3.

So that the angular segment 47 supplying high voltage can be adjusted in the direction of rotation of the back-up cylinder 4 according to the operating conditions required, the entire inductor device 7 can be rotated relative to the back-up cylinder. To indicate the exact angular position of the inner angular segment 47, a graduation 48 is provided, as illustrated in FIG. 1, on the outside of the electrode carrier 12, and this indicates via a fixed rotary-position marking 49 the particular position of the angular segment 47, preferably in relation to the center of the nip 6 (the line 49 in FIG. 4).

I claim:

1. A printing unit comprising an electrostatic printing aid for assisting the transfer of ink from an impression cylinder onto a dielectric substrate web, and further comprising an inductor device concealed against outside access on at least one end face of an outer-shell layer of a back-up cylinder, said inductor being connected in operation with a high voltage source for the electrostatic charging of the outer shell layer, wherein the inductor device has at least one inductor electrode which is connected to a high-voltage supply and is aligned by means of an electrode tip with the edge of said end-face for the purpose of applying the electrostatic charge to said outer-shell layer in a contactless manner, wherein the inductor device (7) has an electrode carrier (12) in the form of a lid with inner face (13) which covers concentrically and conforms in shape to the outer end face (35) of the back-up cylinder (4) and end face edge (10) of its outer shell layer (5) over its entire periphery, in such a way that an annular air gap (15) is formed between the electrode carrier (12) and the outer end faces (35) of the back-up cylinder, and wherein in this annular air gap and located opposite the end-face edge of the outer-shell layer there is an annular groove (16) in which are embedded several inductor electrodes (9), the electrode tips (11) of which, aligned with the end-face edge, project into the annular groove.

2. A printing unit as claimed in claim 1, wherein the inductor electrodes (9) are arranged distributed over the periphery of the annular groove at approximately equal distances from one another.

3. A printing unit as claimed in claim 1, wherein gaskets (17) bridging the annular air gap (15) are provided between the electrode carrier (12) and the outer-shell layer (5) and the annular end-face surface (35) of the back-up cylinder (4).

4. A printing unit as claimed in claim 1, wherein several compressed-air nozzles (18) are provided in the annular groove (16) of the electrode carrier (12), distributed over the periphery of the annular groove, and are connected to a compressed-air source (P) for scavenging the annular air gap (15).

5. A printing unit as claimed in claim 1, wherein an inductor device (7) is provided on each of the two end faces (14) of the back-up cylinder (4).

6. A printing unit as claimed in claim 5, with conduction means having several conduction strips which are worked into the outer-shell layer in a peripheral direction and which are located next to one another axially over the length of the back-up cylinder and at a distance from one another, wherein the conduction means also comprise an inductor ring, located opposite the electrode tips in the electrode carrier and attached to the electrically insulating casing, and finally contact bridges which can be inserted between the inductor ring and the conduction strips in order to connect all or some of the conduction strips or one conduction strip electrically conductively to the indicator ring.

7. A printing unit as claimed in claim 6, wherein the inductor ring (24) or the inductor segment ring (46) has a plurality of small axial bores (40) distributed in a peripheral direction, and wherein the contact bridges (39) assigned to the conduction strips (23) or to the peripheral sectors (45) are steel wires (36) which fit into the axial bores and which can be inserted into selected axial bores depending on the desired connection between the inductor ring (24) and a conduction strip or several conduction strips or between the inductor segment ring (46) and the peripheral sectors (45).

8. A printing unit as claimed in claim 1, in which the conduction means (21) in the outer-shell layer (5) are, at least in the peripheral direction of the back-up cylinder (4), a successive series, interrupted by portions of low charge conductivity, of high-voltage-conducting peripheral sectors (45) which are each connected to a conductive segment surface of an inductor segment ring (46) located on the end-face edge (10), wherein several inductor electrodes (9) are provided in the annular groove (16) solely within an angular segment (47) of the electrode carrier (12), and wherein the electrode carrier (12) is adjustable in the peripheral direction of the back-up cylinder (4), in such a way that the position of the electrodes in the angular segment (47) is variable at least in the region surrounding the nip (6).

9. A printing unit as claimed in claim 8, wherein the angular segment (47) covers a range of approximately 90°–120° of the electrode carrier (12).

10. A printing unit as claimed in claim 8, wherein there is on the outside of the electrode carrier (12) a graduation (48) which indicates via a fixed rotary-position marking (49) the particular rotary position of the angular segment (47) in relation to the center of the nip (6).

11. A printing unit as claimed in claim 1, wherein the outer-shell layer is provided with conduction means which are connected electrically conductively at least to part of its layer surface and which are guided out of this layer at the end-face edge of the outer-shell layer, in such a way that they are located opposite the electrode tips.

12. A printing unit according to claim 1 which is a gravure machine.

* * * * *